United States Patent [19]

Koch et al.

[11] Patent Number: 4,854,585

[45] Date of Patent: Aug. 8, 1989

[54] GOLF SWING TRAINING DEVICE

[76] Inventors: Alfred E. Koch, 17032 Woodleaf Rd.; Robert C. Koch, 15555 Grosse Point Oval, both of Strongsville, Ohio 44136

[21] Appl. No.: 146,396

[22] Filed: Jan. 21, 1988

[51] Int. Cl.[4] ..... A63B 69/36

[52] U.S. Cl. ..... 273/193 B; 273/186 A; 273/29 A

[58] Field of Search ..... 273/32 R, 35 R, 186 R, 273/186 A, 191 R, 193 A, 193 B, 194 R, 80 R, 80.1, 80.2, 80 B, 80 D, 183 D, 193 R, 167 G, 77 R, 164, 29 A; 272/122; 16/115, 322, 321, 334, 235, 237, 239, 241

[56] References Cited

U.S. PATENT DOCUMENTS

| | | | |
|---|---|---|---|
| 1,471,794 | 10/1923 | Leven | 273/186 A |
| 1,524,196 | 1/1925 | Matthews | 273/29 A |
| 1,529,305 | 3/1925 | Gatke | 273/186 A |
| 1,990,281 | 2/1935 | Grelle | 273/186 A |
| 2,005,915 | 6/1935 | Grelle | 273/186 A |
| 2,158,211 | 5/1939 | Aitken | 273/186 A |
| 2,223,647 | 12/1940 | Stumpf | 273/186 A |
| 2,497,237 | 2/1950 | Reineking | 273/193 B |
| 3,033,575 | 5/1962 | Hause | 273/193 B |
| 3,229,980 | 1/1966 | Silberman | 273/186 A |
| 3,606,340 | 9/1971 | Tiller | 273/186 A |
| 3,679,205 | 7/1972 | Finkle et al. | 273/29 A |
| 4,118,033 | 10/1978 | Miyamoto | 273/186 A |
| 4,367,871 | 1/1983 | Schiefer | 273/29 A |
| 4,479,653 | 10/1984 | Woodson | 273/186 A |

*Primary Examiner*—Edward M. Coven
*Assistant Examiner*—S. Passaniti
*Attorney, Agent, or Firm*—Fay, Sharpe, Beall, Fagan, Minnich & McKee

[57] ABSTRACT

A golf swing training device including a two-way hinge mechanism interposed between the grip and head of a golf club shaft. The hinge mechanism includes a female member having yoke portions defining a cavity adapted to receive a male member therebetween. A pivot pin is received through aligned apertures to permit articulating movement of the male member relative to the female member.

6 Claims, 2 Drawing Sheets

GOLF SWING TRAINING DEVICE

BACKGROUND OF THE INVENTION

This application pertains to the art of training devices and more particularly to a golf swing training device. The invention is particularly applicable to a golf swing training device that permits a golfer to hit a golf ball and will be described with particular reference thereto. However, it will be appreciated that the invention has broader applications and may also be employed without a golf ball.

A number of golf swing training devices are known in the art. In fact, a variety of patents incorporate a hinge mechanism in the shaft of the golf club to correct various deficiencies in a golfer's swing. Among these patents is included U.S. Pat. No. 3,033,575 to Haute, issued May 8, 1962, that illustrates a practice golf club utilizing a one-way hinge that permits the head of the club to pivot relative to the grip when the club is improperly swung. Unfortunately, the design of the hinge mechanism facilitates only a one-way movement of the club head relative to the grip, i.e., to pivot rearwardly and upwardly as described in that patent. In a similar fashion, U.S. Pat. No. 2,497,237 to Reineking, issued Feb. 14, 1950, discloses a similar, practice type golf club embodying a different one-way hinge mechanism. Once again, only selected faults in a golfer's swing will be detected by the one-way hinge mechanism. Moreover, a golfer's faulty swing may not be rectified due to the structural limitations of the training club.

U.S. Pat. Nos. 1,990,281, issued Feb. 5, 1935, and 2,005,915, issued June 25, 1935, to Grelle illustrate a break-away golf club grip portion resulting from overplay of a golfer's right hand in his swing. The Grelle '915 patent even recognizes the desirability of using the club to strike a ball without the grip portion becoming detached. Unfortunately, this patent requires a stop finger to be positioned adjacent the grip handle to absorb the shock of the club head in hitting the ball.

None of the prior art teaches or suggests an arrangement of a two-way hinge in a golf swing training device that permits indication of faults in both backswing and downswing of a golf stroke. Additionally, prior arrangements have not adequately addressed the problem of striking a golf ball without articulating or breaking the hinge.

The subject invention is deemed to overcome these problems and others, and provides a golf swing training device adapted for use with or without striking a golf ball.

SUMMARY OF THE INVENTION

In accordance with the present invention, there is provided a simplified, adjustable golf swing training device that facilitates correction of a wide array of faults of a golf swing and provides the option of striking or not striking a golf ball.

According to a more limited aspect of the invention, the golf swing training device includes an elongated shaft having a grip at one end and a club head at an opposed end. A hinge mechanism is interposed between the grip and club head. The hinge mechanism includes a female member having first and second yoke portions defining a cavity permitting two-way movement of a male member between the yoke portions. An adjusting screw cooperates with a biasing spring and generally spherical member to adjust the force necessary to break or articulate the hinge mechanism.

According to a more limited aspect of the invention, smooth arcuate surfaces are provided on the male and female members of the hinge mechanism to facilitate two-way movement therebetween. A principal advantage of the invention is the correction of various faults in a golfer's swing.

Another advantage of the invention resides in the simplified construction of the hinge mechanism and adaptability to a conventional golf club with minimal effort.

Yet another advantage is found in the ability to strike a golf ball with the training device if desired and simultaneously perceive the accuracy of a golf swing by observing the flight of the ball.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE PREFERRED EMBODIMENT

Figure 1:
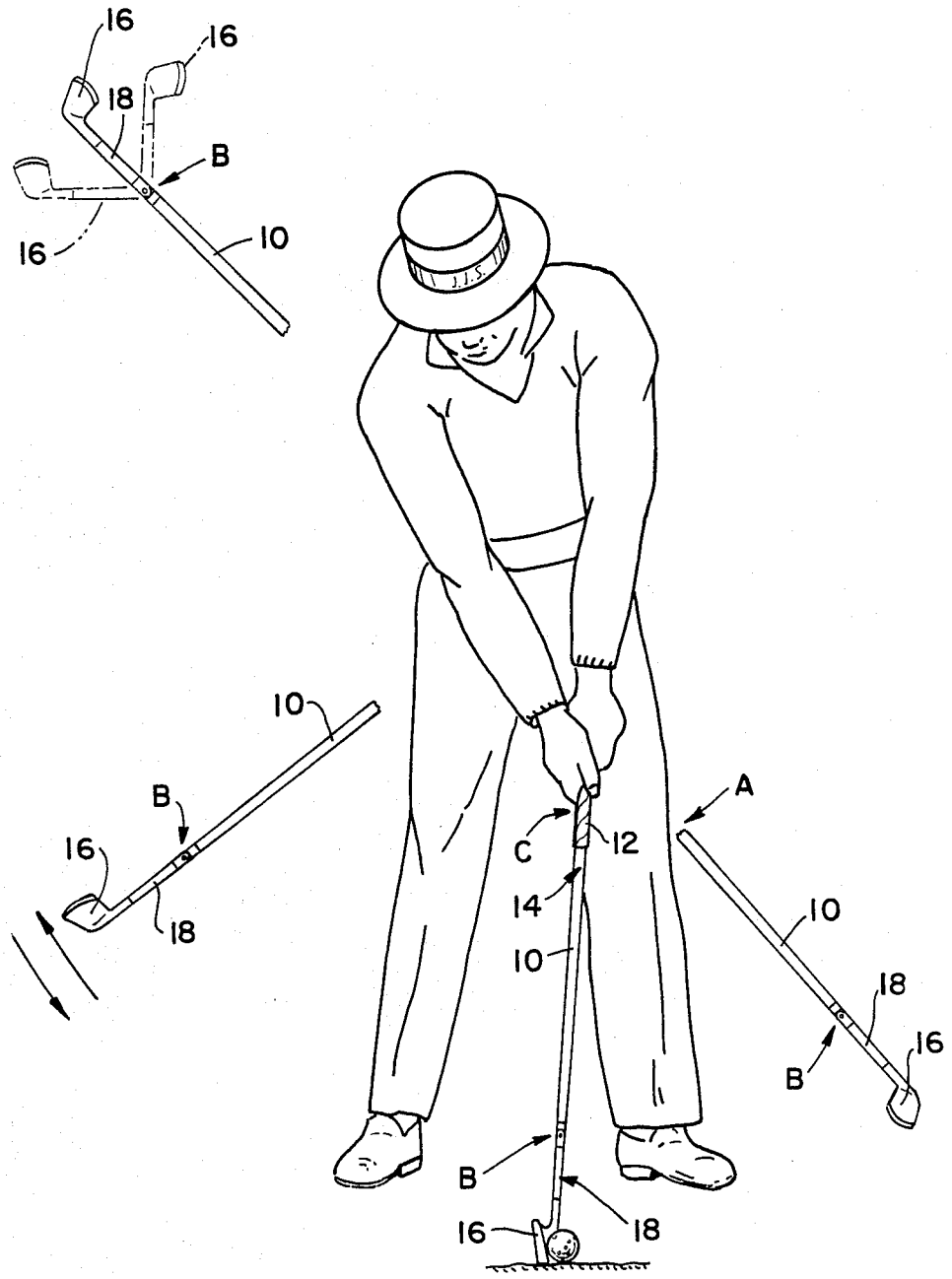
FIG. 1 illustrates a training device at various positions through a golf swing, with breaks in the hinge mechanism illustrated in phantom.

Referring now to the drawings wherein the showings are for purposes of illustrating the preferred embodiment of the invention only and not for purposes of limiting same, the FIGURES show a golf swing training device A having a hinge mechanism B incorporated into a golf club shaft C.

More particularly, the golf club C may comprise a wood or iron of conventional design. The club includes an elongated shaft 10 having a handle or grip portion 12 at a first or upper end 14. A club head 16 is disposed on the second or lower end 18.

Figure 2:
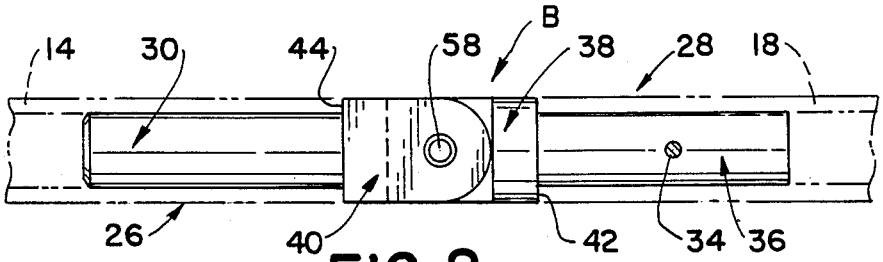
FIG. 2 is a detailed plan view of the hinge mechanism incorporated into the golf club shaft.

With particular reference to FIG. 2, and additional reference to FIGS. 3-6, the hinge mechanism B will be described in greater detail. The hinge mechanism includes two major components; namely, a female member 26 and a male member 28. Preferably the female member is secured at a first end 30 to an upper end 14 of the shaft. In the preferred assembly shown in FIG. 2, the female member 26 and the shaft upper end 14 are epoxied together. Similarly, the male member is secured at a first end 36 to a lower end 18 of the shaft. In the preferred assembly shown in FIG. 2, the male member 28 and the shaft lower end 18 are epoxied together.

Of course alternative arrangements for securing the hinge mechanism components to the shaft may be utilized without departing from the scope and intent of the subject invention. For example, the male member 28 may be secured through use of a press-fit pin 34 that extends through a portion of the shaft and a first end 36 of the male member. Alternatively, a combined epoxy and pin connection can be used with equal success.

The first ends 30, 36 of the female and male hinge members, respectively, have a generally cylindrical configuration that readily conforms to the tubular construction of a conventional golf club shaft. That is, the first ends 30, 36 have an outer diametrical dimension that closely approximates an inner diameter of an associated club shaft to matingly receive the shaft thereover. Respective second ends 38, 40 of the male and female members have an enlarged diameter relative to the first ends to define radial shoulders 42, 44. The radial shoulders abuttingly engage terminal ends of the tubular shaft portions 18, 14 and positively locate the hinge mechanism thereto.

Figure 3:
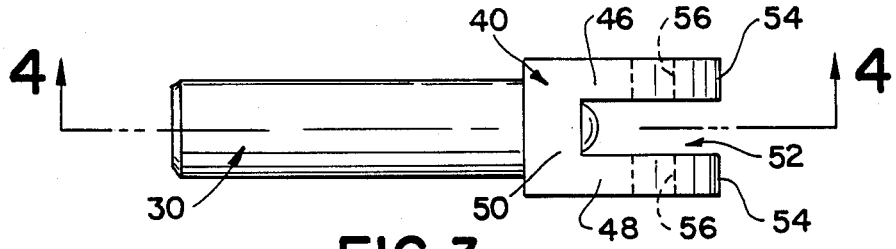
FIG. 3 is a top view of the female member of the hinge mechanism.

The second end 40 of the female member 26 includes first and second yoke portions 46, 48 (FIG. 3). The yoke portions extend axially and generally parallel to the longitudinal dimension of the shaft. An interconnecting portion or web 50 joins one end of each yoke portion to define a generally U-shaped cavity 50. The U-shaped cavity facilitates two-way movement of the hinge mechanism as will become apparent below.

Each yoke portion 46, 48 includes a smooth, arcuate surface 54 along the terminal edge of the female member second end 40. Moreover, an aperture 56 extends through each of the yoke portions in a direction generally perpendicular to the longitudinal extent of the shaft. The apertures in the respective yoke portions are aligned to receive a pivot pin 58 that secures the male and female members of the hinge mechanism together. The pivot pin locks the male and female members against axial movement but permits relative rotation therearound as will hereinafter be termed breaking or articulating the hinge mechanism.

Figure 4:
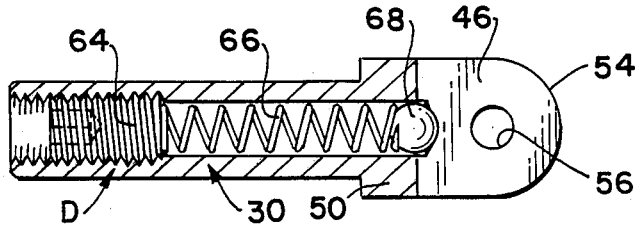
FIG. 4 is a partial cross-sectional view generally along the lines 4—4 of FIG. 3.

Turning now to FIG. 4, the first end 30 of the female member is of hollow configuration adapted to accommodate an adjustable tensioning means D for the hinge mechanism. The first end 30 is integrally threaded to receive an adjusting screw 64. An outer end of the adjusting screw may be slotted or otherwise configured to receive an adjusting tool such as a screwdriver (not shown). An inner end of the adjusting screw abuttingly engages one end of a biasing means such as helical spring 66. The other end of the spring engages a generally spherical member or ball 68 that extends partially into the cavity 52. Selective axial advancement and retraction of the screw adjusts the biasing force on the ball member to, in turn, adjust the force necessary to articulate the hinge mechanism around pivot pin 58.

Preferably, the spring 66 is of chromium silicon wire manufacture. The forces and resultant wear and tear on the spring necessitate a durable material. Experimentation with different material constructions has resulted in the preference of the chromium silicate material. Of course, those skilled in the art will recognize that alternative materials may be used with equal success.

Figure 5:
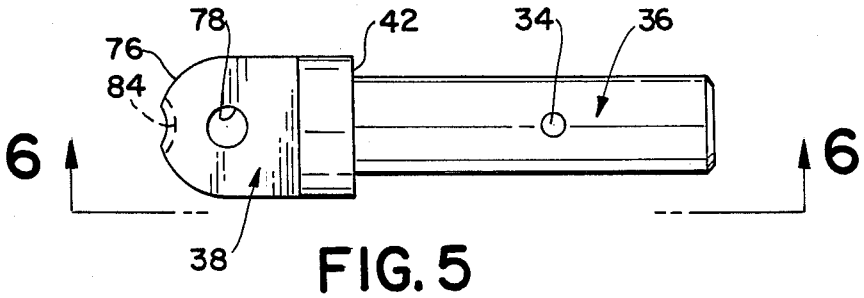
FIG. 5 is a side elevational view of the male member of the hinge mechanism; and, FIG. 6 is a top view of the male member of the hinge mechanism generally along the lines 6—6 of FIG. 5.
Figure 6:
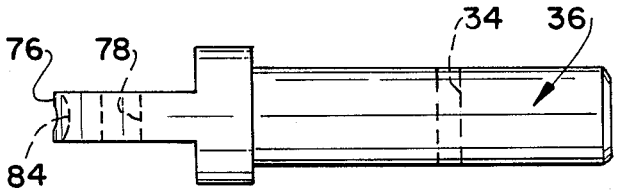

The male member of the hinge mechanism is particularly shown in FIGS. 5 and 6. The male member includes a smooth arcuate surface 76 that permits clockwise and counterclockwise articulation of the male member relative to the female member. A generally centrally located aperture 78 receives pivot pin 58 therethrough to secure the male and female members of the hinge mechanism together as described above. A spherically-shaped recess 84 is defined at the terminal end of the male member to matingly receive the external surface of ball 68. The recess 84 assures sufficient contact with the female member to maintain axial alignment of the hinge mechanism until a predetermined force generated by a faulty swing overcomes the biasing force of the spring and permits selective articulation of the hinge mechanism.

Since many faulty golf swings result from a failure to maintain the face of the club head perpendicular to the projected line of travel of the golf ball, aberrations from the ideal golf swing result in uneven movements in the swing. Positioning of the hands and arms is critical, as is placement of the hinge mechanism in the shaft. Slight deviations in the hands and arm movement of the swing are magnified by the club length. The shaft acts as a lever arm and forces imparted through the hands are coupled with the shaft length to exert a moment or torque about the hinge mechanism pivot pin.

Of equal importance, is that the moment arm or length of shaft between the club head and the hinge mechanism is precisely maintained so that a ball may be struck by the club head without articulating the hinge mechanism. By way of example, one common problem known as 'casting' results from overplay of the right hand at the beginning of the downswing movement in a golf stroke. This will cause the hinge mechanism to break indicating an overplay of the right hand. Likewise, failure to maintain the club face square throughout the swing either through an outside-inside swing, also known as "slicing", or an inside-outside swing, also known as "hooking", results in the hinge mechanism breaking either forwardly or rearwardly. By maintaining the club face in a square position and maintaining a smooth swing, the hinge mechanism will remain in its aligned relationship and permit striking of a golf ball.

Placement of the hinge mechanism is determined through the centroid or center of mass of the golf club. For example, the golf club is disposed in a generally horizontal plane and the centroid is determined by selectively positioning a fulcrum underneath the golf club. Once the fulcrum is located at the center of mass, rotational motion of the golf club ceases and the club is balanced. When balanced in this manner, the fulcrum indicates placement of the hinge mechanism. Since the club head is typically of greater mass and weight than the grip, the hinge mechanism is located more closely to the club head with the resulting effects described above. Alternatively, location of the hinge mechanism may be determined on the basis of dynamic use of the golf club.

The invention has been described with reference to the preferred embodiment. Obviously modifications and alterations will occur to others upon a reading and understanding of the specification. It is intended to include all such modifications and alterations insofar as they come within the scope of the appended claims or the equivalents thereof.

Having this discribed the invention, it is now claimed:

1. A golf swing training device comprising: comprising:

an elongated shaft having a grip at a first end and a club head at an opposed, second end;

a hinge mechanism interposed between said first and second ends, said hinge mechanism including a female member having a generally hollow, cylindrical portion at one end and axially extending first and second yoke portions at the other end defining a cavity therebetween, terminal ends of said first and second yoke portions having smooth arcuate surfaces to permit two-way movement of the hinge mechanism, an adjusting screw threadably received in said hollow portion for selective axial movement therein;

a biasing means received in said hollow portion having one end operatively engaging said adjusting screw;

a generally spherical member operatively engaging the other end of said biasing means, said spherical member being urged axially toward said cavity;

a male member having a smooth arcuate surface received in said female member cavity to permit selective articulation of the hinge mechanism such that said second shaft end is displaceable out of line from said first shaft end both rearwardly and forwardly in either one of two opposing directions relative to the longitudinal axis passing through the elongated shaft, said male member arcuate surface including a generally spherical recess disposed in a central external surface portion thereof for receipt of said spherical member at an area opposite said biasing means;

means for interconnecting said hinge mechanism to said elongated shaft; and, means for pivotally securing said male and female member of said hinge mechanism.

2. The device as defined in claim 1 wherein said securing means includes aligned apertures in each of said first and second yoke portions and said male member.

3. The device as defined in claim 2 wherein securing means includes a pin member for receipt in said aligned apertures.

4. The device as claimed in claim 1 wherein said hinge mechanism is disposed closer to said second end than said first end.

5. The device as defined in claim 1 wherein said biasing means includes a spring.

6. The device as defined in claim 1 wherein said hinge mechanism is located at the centroid of the shaft.

* * * * *